United States Patent [19]

Kirkland et al.

[11] Patent Number: 4,936,815

[45] Date of Patent: Jun. 26, 1990

[54] TRAY FORMING MACHINE

[75] Inventors: Thomas R. Kirkland, Rockford, Minn.; Norman Pratt, Waukegan; Edwin Larson, Ingleside, both of Ill.

[73] Assignee: Liberty Diversified Industries, New Hope, Minn.

[21] Appl. No.: 135,211

[22] Filed: Apr. 18, 1988

[51] Int. Cl.[5] ..... B31B 3/46; B31B 3/06

[52] U.S. Cl. ..... 493/125; 493/126; 493/133; 493/167

[58] Field of Search ..... 493/125, 126, 133, 134, 493/143, 167

[56] References Cited

U.S. PATENT DOCUMENTS

| | | | |
|---|---|---|---|
| 2,398,200 | 4/1946 | Van Voorhis | 493/143 |
| 3,008,386 | 11/1961 | Mosse | 493/126 |
| 3,511,140 | 5/1970 | Hoyrup | 493/134 |
| 3,593,623 | 7/1971 | Oakley | 493/133 |
| 3,955,482 | 5/1976 | Moen | 493/134 |
| 4,295,839 | 10/1981 | Baker et al. | 493/143 |
| 4,522,618 | 6/1985 | Stannard | 493/143 |
| 4,549,876 | 10/1985 | Baker et al. | 493/169 |
| 4,581,005 | 4/1986 | Moen | 493/167 |
| 4,588,390 | 5/1986 | Heitele et al. | 493/133 |
| 4,636,187 | 1/1987 | Oakley | 493/134 |

*Primary Examiner*—William Terrell

*Attorney, Agent, or Firm*—Moore & Hansen

[57] ABSTRACT

A tray forming machine comprising an infeed station for accepting a blank of corrugated plastic, and a transfer mechanism which automatically conveys the blank along a plane into a blank receiving station between a tray forming ram and a forming tool frame. The tray forming ram moves downward along a vertical path carrying the blank through the forming tool frame, during which the blank is folded into a generally upright tray configuration by a series of vertically displaced side and end forming bars and brackets. The tray forming ram and blank emerge from the forming tool frame and are received in a clamping and welding assembly which holds the blank in position while it is secured by sonic welds into the upright tray. The clamping assembly releases while the tray forming ram returns to its raised position, and the tray is stripped off the tray forming ram by the bottom of the forming brackets. The tray falls due to gravity onto a conveyor beneath the forming tool frame, and the trays are individually removed.

25 Claims, 5 Drawing Sheets

TRAY FORMING MACHINE

BACKGROUND OF THE INVENTION

This invention relates generally to machines used to fold a blank into an upright tote container, and particularly to a machine for automatically folding a blank constructed from double-faced corrugated plastic into an upright tray and securing the tray in that upright configuration.

Various machines for folding and securing cartons and tote containers are known to the art. These machines will generally comprise a plurality of stations for feeding a cut blank into a forming area, forming the blank into an upright container by folding certain panels of the blank upwardly and inwardly, and securing those panels together with fasteners, glue, or various tab and slot structures. Some forming machines perform the dual functions of cutting the blank from a roll of sheet material, prescoring the blank at the infeed station, and forming the upright tote container.

These machines operate in a variety of manners depending upon particular design of the type of container being constructed, the type of material from which the blank is formed, and the relative expense of the machine compared to the rate at which it can produce finished containers.

Some machines used predominantly with fiberboard cartons will convey the blank along between a series of assembly stations, with various panels being folded or secured at each step of the process.

Another type of machine commonly referred to as a tunnel-forming type machine has an infeed system which lifts a blank from a stack on a pallet, transfers it laterally to a position over a forming tunnel, and then a mandrel will carry the blank through the tunnel which various components perform folding and sealing operations, with the finished containers being nested at a loading station.

A third type of forming machine, used more extensively with shallow trays formed from rigid materials which are seamed together at the edges, incorporates a female forming die and a mandrel to press the blank into the forming die, and various stripping means to remove the tray from either the mandrel or the forming die.

Several distinct problems with forming corrugated plastic containers have resulted in many containers being folded and secured manually. The blanks may be cut and scored to form individual and hingedly connected panels by an automated die cutting machine, with the blank then being folded by hand and stapled or thermally welded in an upright configuration. Because double-faced corrugated plastic is generally very resilient and has memory properties which resist folding even when deeply scored, unlike fiberboard, it is difficult to manage the steps of folding and holding a container in its upright configuration while securing the panels together.

This resiliency also makes corrugated plastic difficult to use with standard forming tools, because the resistance encountered in carrying the blank through the forming die can cut or tear the planar plys, again with a deleterious effect on the finished container.

The process of producing sonic welds to fasten the panels thermally or physically bonds the three plys of the corrugated plastic sheet material to the three plys in the adjacent and confronting panels. The quality of the sonic weld depends upon the accuracy and uniformity of the gap between the welding head and the backup plate, with poor quality welds resulting in tearing of the generally planar plys and an overall weakening of the tray being formed. Placement of the welds relative to the edges of the panels and the corrugated intermediate ply is also of concern, factors which are difficult to control in both manual and automated tray forming and securing procedure.

Conventional container and tray forming machines encounter significant speed restraints when processing corrugated plastics, and the complex or heavy duty machines capable of running corrugated plastic may often be too complex, expensive, or difficult to repair and maintain to be practical in certain applications.

Another common drawback with several designs of forming machines is their inability to process corrugated plastic blanks having any significant measure of longitudinal or lateral warp, such a warp interfering with the loading or infeeding operations of the blank, or causing the machine to jam or bind during the forming operation. While fiberboard blanks are generally flat, corrugated plastic blanks may develop a warp in excess of 10% of their longitudinal span due to heat and humidity variations. Because the corrugated plastic sheet material is more expensive than fiberboard, and because it is usually easier to visually detect damaged or inferior fiberboard, it is desirable that the tray forming machine be capable of running corrugated plastic blanks having a substantial measure of warp.

While many of the obstacles may be controlled to some degree in a carefully monitored production environment using skilled operators and technicians, these machines will not perform satisfactorily or reliably in situations involving relatively unskilled operators or in the absence of qualified technical help and repair or maintenance equipment. As such, these machines are not suitable for institutional or training use, such as in correctional facilities of trade schools.

In such situations, it is also critically important to build in the greatest degree of safety and operator protection, to minimize the opportunities for the machine to be operated improperly or tampered with, to facilitate simple and rapid repair of even the more complicated features, and to minimize the number of potential technical problems which might result from variations in the consistency of the sheet material, environmental conditions, and the like.

BRIEF SUMMARY OF THE INVENTION

It is therefore one object of this invention to design a tray forming machine which utilizes a tray forming ram and forming tool frame which permits a tunnel-like forming procedure, but which requires only a minimal ram stroke distance and machine cycling period.

It is an additional object of this invention to design the tray forming machine of this invention such that the infeeding of blanks may be operated manually, or the machine may be converted for automated blank feeding.

It is a related object of this invention to design the above tray forming machine such that a blank magazine situated above the infeed station may be utilized rather than a vertical lift type blank feeding apparatus.

It is another object of this invention to design the above tray forming machine so as to utilize a minimum number of moving parts, to consolidate the functions and timing of those parts, and to simplify the operation and maintenance of the machine, while increasing the overall reliability and performance characteristics of that machine.

It is thus a related object to design the above tray forming machine so as to provide for the automatic stripping of individual trays from the ram and forming frame without separate stripping arms or extending the ram stroke, and to output those trays individually from the machine onto a conveyor system.

It is yet another object of this invention to design the above tray forming machine so as to enhance the accuracy and reliability in positioning and aligning the ram, forming tool, and clamping means, and to increase the uniformity of the sonic welds used to secure the tray in its upright configuration.

It is a distinct object of this invention to design the above tray forming machine such that the cycling of the machine may be keyed to the disposition of the ram, and such that certain types of piece-in-place sensors and obstruction interrupts may be utilized in automating the cycling of the machine, to provide for greater operator safety and minimize potential faults or problems in the operation of the machine.

It is a related object of this invention to design the above tray forming machine such that blanks of slightly varying sizes, warps, or consistencies may be utilized in the machine, or may be detected and the cycling of the machine interrupted prior to an unsuccessful attempt to process the defective blank.

Briefly described, the tray forming machine of this invention comprises an infeed station for accepting a blank of corrugated plastic, and a transfer mechanism which automatically conveys the blank along a plane into a blank receiving station between a tray forming ram and a forming tool frame. The tray forming ram moves downward along a vertical path carrying the blank through the forming tool frame, during which the blank is folded into a generally upright tray configuration by a series of vertically displaced side and end forming bars and brackets. The tray forming ram and blank emerge from the forming tool frame and are received in a clamping and welding assembly which holds the blank in position while it is secured by sonic welds into the upright tray. The clamping assembly releases while the tray forming ram returns to its raised position, and the tray is stripped off the tray forming ram by the bottom of the forming brackets. The tray falls due to gravity onto a conveyor beneath the forming tool frame, and the trays are individually removed.

DESCRIPTION OF THE PREFERRED EMBODIMENTS

The tray forming machine of this invention is shown in FIGS. 1-13 and referenced generally therein by the numeral 10.

Figure 1:
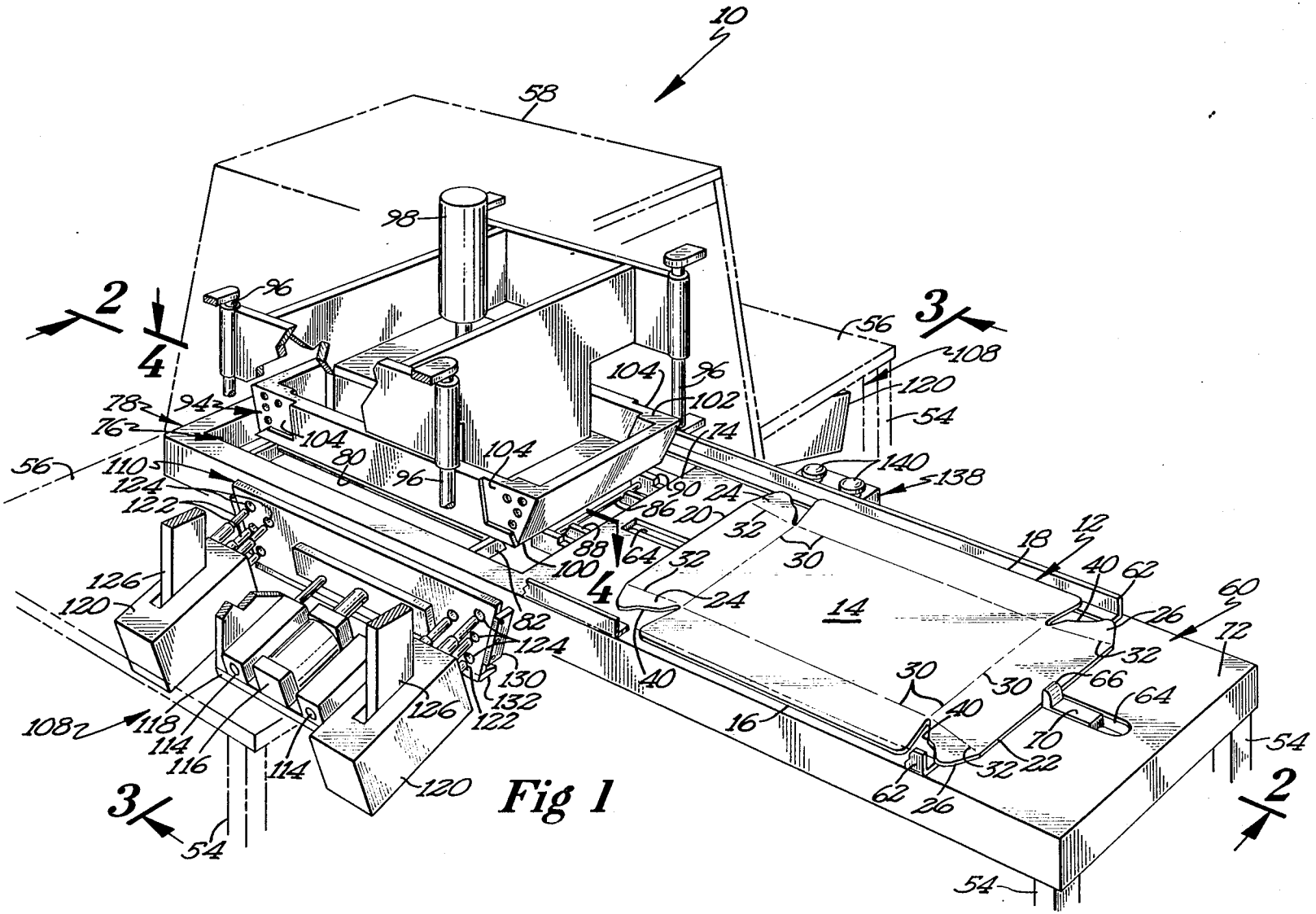
FIG. 1 is a perspective view of the tray forming machine of this invention.

The embodiment of the tray forming machine 10 shown is particularly adapted to be used with a blank 12 having a base panel 14, a pair of opposing side panels 16, 18, a pair of opposing end panels 20, 22 with each of the end panels 20, 22 having a pair of end foldover panels 24, 26 extending therefrom, as shown in FIG. 1. The blank 12 is constructed by cutting and scoring a generally planar sheet of double-faced corrugated plastic 28 to form the various panels 14, 16, 18, 20, 22, 24, 26.

The side panels 16, 18 and end panels 20, 22 may respectively be hingedly connected along the lengthwise and widthwise edges of the base panel 14 by prescored fold lines 30, and the end foldover panels 24, 26 may be hingedly connected to the side edges of the end panels 20, 22 by prescored fold lines 32. It may also be desirable, particularly in some applications where a more rigid or stiff blank 12 is preferred, to leave the blank 12 unscored or only score those fold lines 32 connecting the end foldover panels 24, 26 to the respective end panels 20, 22, and permit the tray forming machine 10 to form the hinged fold lines 30 between the lengthwise and widthwise edges of the base panel 14 and the side panels 16, 18 and end panels 20, 22.

Figure 13:
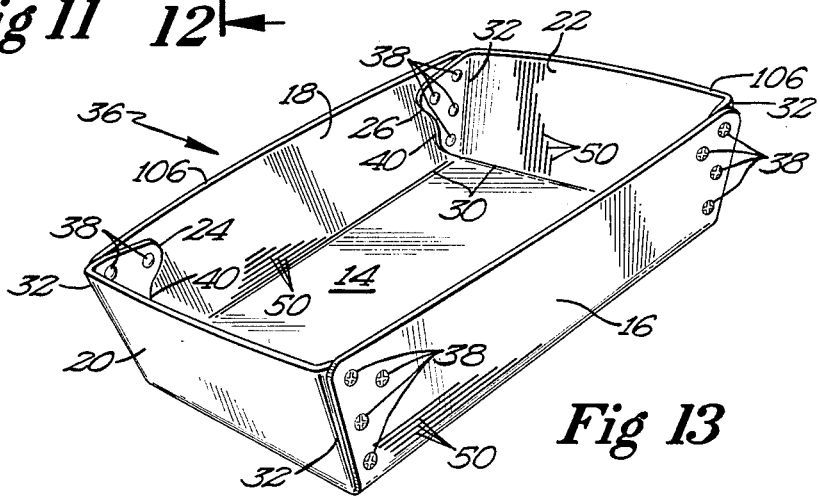
FIG. 13 is a perspective view of the blank folded into the generally upright tray configuration.

The end foldover panels 24, 26 are folded upwardly relative to the end panels 20, 22 of the flattened blank 12 across the fold lines 32 until the end foldover panels 24, 26 are generally perpendicular to the end panels 20, 22. The end panels 20, 22 may then be folded upwardly relative to the base panel 14 across fold lines 30, with the end foldover panels 24, 26 being pivoted inwardly across the fold lines 30 relative to the base panel 14, until the end panels 20, 22 form an angle $\beta$ with the base panel 14 somewhat greater than 90°. The side panels 16, 18 are then folded upwardly relative to the base panel 14 across the fold lines 30, until the inner planar surface of each side panel 16, 18 contacts the outer planar surface of one of the end foldover panels 24, 26 connected to each of the end panels 20, 22. In this manner, the blank 12 is folded to the upright tray configuration 36 as shown in FIG. 13. The side panels 16, 18 may then be fastened to the end foldover panels 24, 26 such as by a plurality of sonic welds 38 to secure the tray 36 in this generally upright configuration. It is noted that the end edges of side panels 16, 18 are cut at an angle $\partial$ relative to the fold lines 30 between the side panels 16, 18 and the base panel 14 substantially equal to the angle $\beta$ between the end panels 20, 22 and base panel 14 when the end panels 20, 22 are folded into position in the generally upright tray configuration 36. Similarly, the side edges of each end panel 20, 22 are cut at an angle $\phi$ relative to the fold lines 32 between the end panels 20, 22 and the end foldover panels 24, 26 substantially equal to the angle $\beta$, such that the side panels 16, 18 and end panels 20, 22 each have a generally tapered, outward slant when folded into position in the generally upright tray configuration 36.

In folding the tray 36 into the generally upright configuration using an automated tray forming machine 10 of the type of this invention, it may sometimes be unnecessary or undesirable to completely fold the end foldover panels 24, 26 upwardly until the end foldover panels 24, 26 are perpendicular with the end panels 20, 22 prior to beginning the steps of folding the end panels 20, 22 and side panels 16, 18 upward. To facilitate such a folding procedure, the inwardly facing edge 40 of each end foldover panels 24, 26 may define a generally concave curved path bounded by convexly curved corners, the curvature of the end foldover panels 24, 26 preventing the end edges of the side panels 16, 18 from catching or binding against the inwardly facing edges 40 of the end foldover panels 24, 26 as the end foldover panels 24, 26 are pivoted upwardly with the end panels 20, 22.

Figure 9:
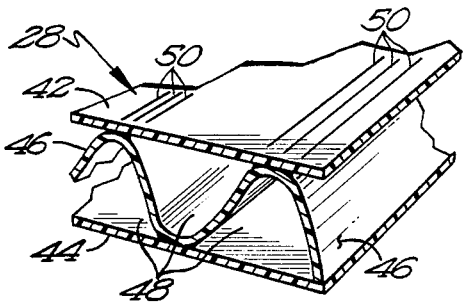
FIG. 9 is a cross sectional view of the convoluted ply embodiment of the double-faced corrugated plastic sheet material from which the blank is cut and folded.
Figure 10:
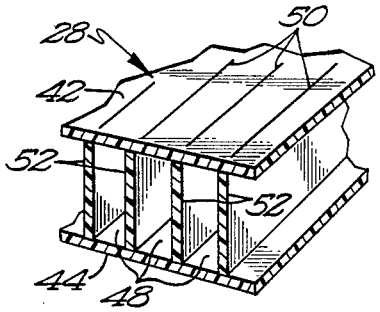
FIG. 10 is a cross sectional view of the beam member embodiment of the double-faced corrugated plastic sheet material from which the blank is cut and folded.

Referring to FIG. 9, it may be seen that the double-faced corrugated plastic sheet material 28 is comprised of a first planar ply 42 spaced apart from a second planar ply 44, with a convoluted intermediate ply 46 extending therebetween and being bonded to the planar plys 42, 44 to form a series of spaced apart air pockets 48, the convoluted intermediate ply 46 and air pockets 48 defining a longitudinal parallel grain 50 extending along the sheet material 28. Referring particularly to FIG. 10, it may be seen that the convoluted intermediate ply 46 may take the form of a plurality of separate, beam-like members 52 extending between the planar plys 42, 44, and similarly defining air pockets 48 and a grain 50.

Referring to FIG. 1, it may be seen that the tray forming machine 10 is mounted to and includes a support frame 54 which includes a plurality of generally horizontal table-like extensions 56. Portions of the tray forming machine 10 are mounted above and below the table-like extensions 56 of the support frame 54, with portions of the tray forming machine 10 disposed above the table-like extensions 56 being covered by a housing 58 constructed from materials such as sheet metal and plexiglas.

One of the table-like extensions 56 of the support frame 54 defines an infeed station 60 at the front end of the tray forming machine 10. Individual blanks 12 may be placed generally horizontally on top of the infeed station 60 by a user standing on either side of the infeed station 60, with the blank 12 being positioned between and overlaying a pair of spaced apart L-shaped guide rails 62 which extend substantially the entire length of the infeed station and into the housing 58.

Figure 2:
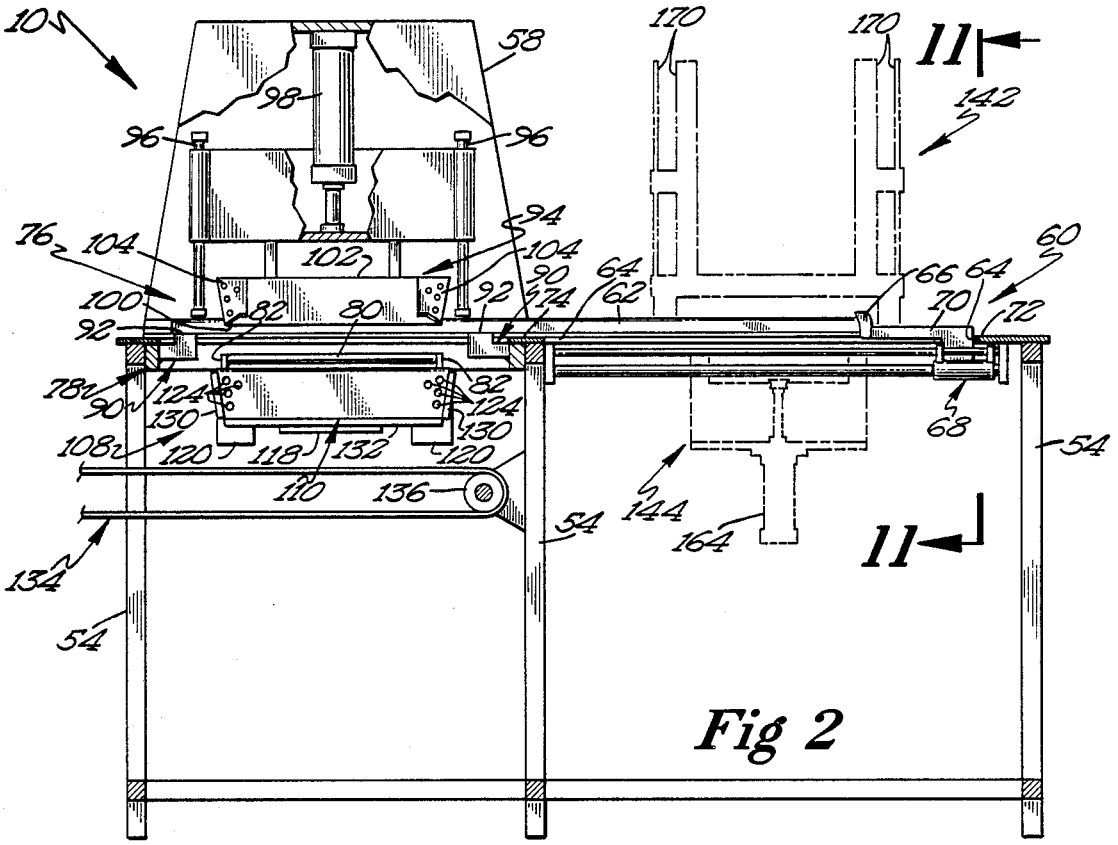
FIG. 2 is a cross sectional view of the tray forming machine of FIG. 1 taken lengthwise through line 2—2 in FIG. 1.
Figure 3:
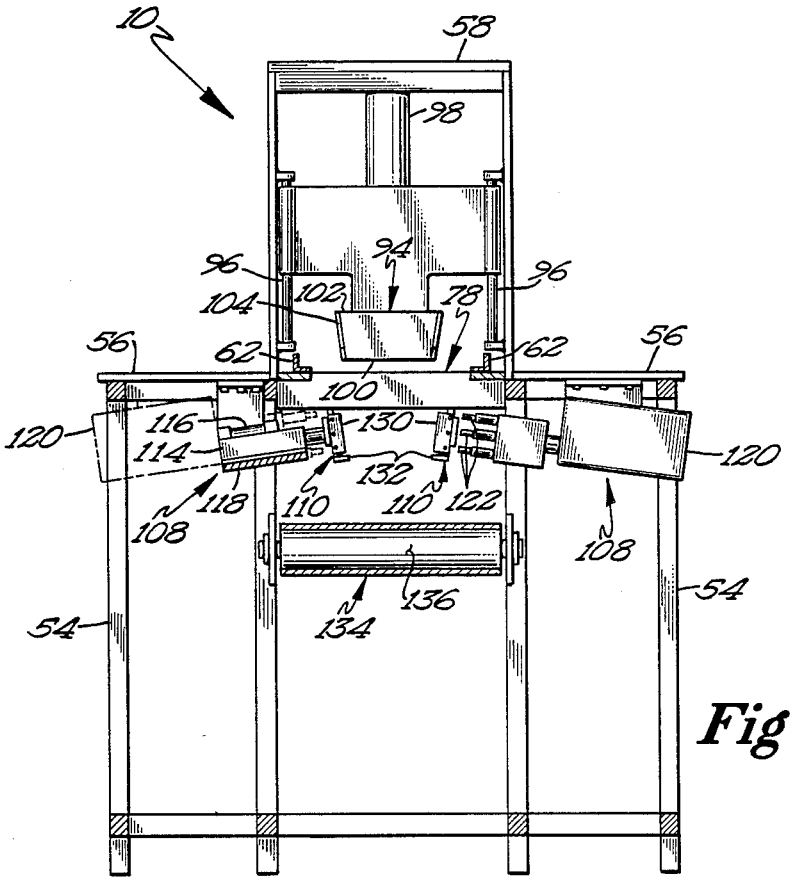
FIG. 3 is a cross sectional view of the tray forming machine of FIG. 1 taken widthwise through line 3—3 in FIG. 1.
Figure 4:
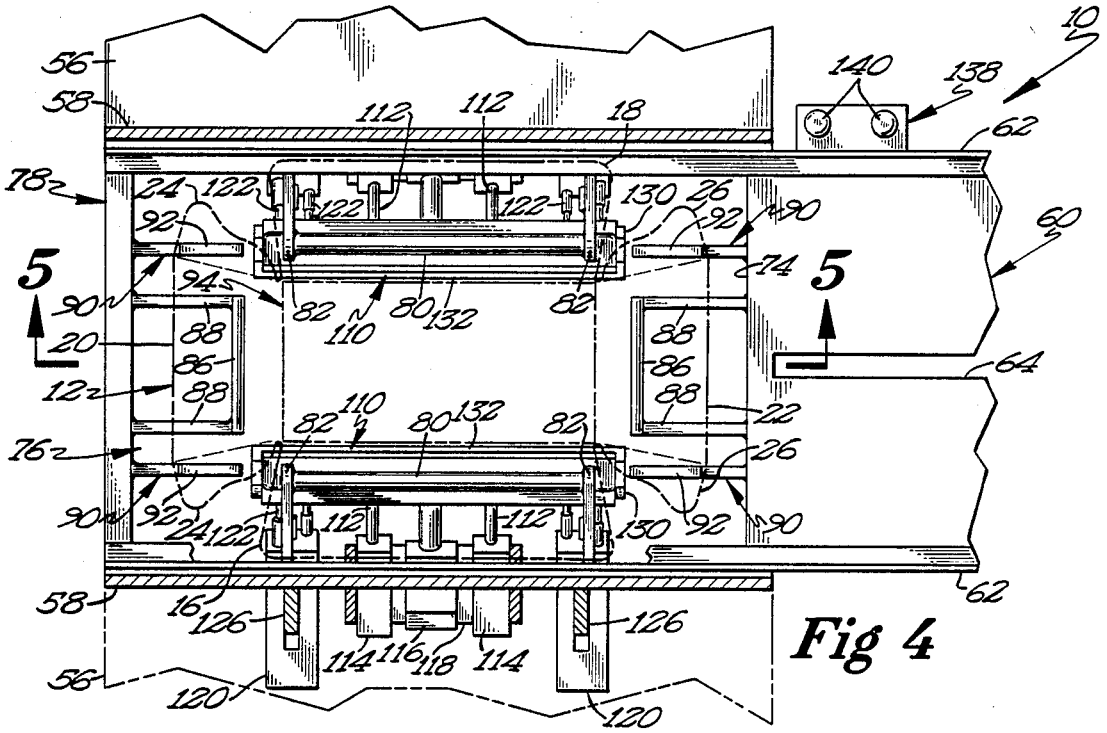
FIG. 4 is a cross sectional view of the tray forming machine of FIG. 1 taken from above through line 4—4 of FIG. 1.

Referring to FIGS. 1, 2, and 4, it may be seen that the table-like extension 56 of the infeed station 60 defines a longitudinal track 64 extending entirely through the surface thereof and traversing the length of the table-like extension 56. Extending through the track 64 is an infeed hook 66 connected to rodless cylinder 68 by an L-shaped push arm 70, the infeed hook 66, rodless cylinder 68, and push arm 70 comprising a transfer mechanism for transporting the blank 12. The infeed hook 66 and push arm 70 may be moved or carried longitudinally back and forth along the length of the infeed station 60 between a blank receiving position closely adjacent the front end 72 of the infeed station 60 and a blank delivery position closely adjacent the rear end 74 of the infeed station 60.

Adjacent to the rear end 74 of the infeed station 60 and longitudinally aligned with the infeed station 60 is a blank receiving station 76 having a generally rectangular forming tool frame 78 fastened to the support frame 54 and accurately positioned thereon with a dowel type assembly.

A blank 12 may be manually placed within the infeed station as shown in FIG. 1 when the infeed hook 66 and push bar 70 are located at the blank receiving position adjacent the front end 72 of the infeed station 60 with the edge of one of the end panels 22 contacting or proximate to the infeed hook 66, and when the infeed hook 66 and push bar 70 are moved by the rodless cylinder 68 to the blank delivery position adjacent the rear end 74 of the infeed station 60, the infeed hook 66 will press against the edge of the blank 12 and slidably transport the blank 12 along the guide rails 62 until the blank 12 is completely received within the blank receiving station 76 above the forming tool frame 78. As such, the infeed hook 66 should extend upwardly a distance sufficient to prevent the infeed hook 66 from sliding under the blank 12. Also, the top surface of the infeed hook 66 may have a generally convex curvature such that if a blank 12 is accidentally placed in the infeed station 60 while the infeed hook 66 is adjacent the rear end 74 of the infeed station 60, the infeed hook 66 will lift the edge of the blank 12 and pass under the blank 12 as the infeed hook 66 returns to the front end 72 of the infeed station 60.

Figure 6:
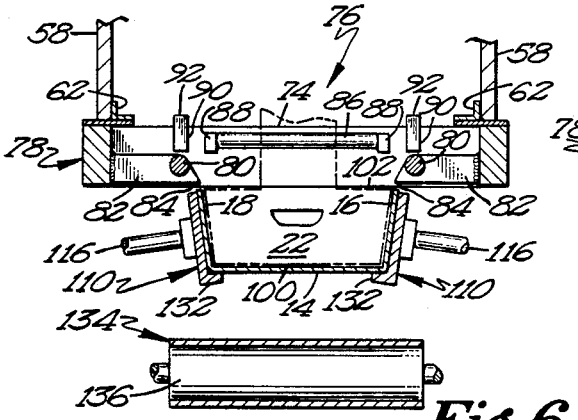
FIG. 6 is a cross sectional view of the tray forming machine of FIG. 1 taken widthwise through line 6—6 in FIG. 5 showing the side clamps in the extended clamping position.

Extending inwardly from the lengthwise sides of the forming tool frame 78 are a pair of side forming bars 80, each side forming bar 80 being mounted between a pair of parallel side forming brackets 82. Referring to FIG. 6, it may be seen that the side forming brackets 82 have an inwardly projecting angular lower lip 84, and the top corner surface adjacent the ends of the side forming bar 80 may be rounded.

Extending from each of the widthwise sides of the forming tool frame 78 are a pair of end forming bars 86, each end forming bar 86 mounted between a pair of parallel end forming brackets 88, and a pair of end foldover forming bars 90 each having a raised top portion 92 which is substantially coplanar with the top surface of the table-like extension 56 adjacent the rear end 74 of the infeed station 60, each end foldover forming bar 90 being oriented generally parallel to the end forming brackets 88 and positioned on opposing sides of the corresponding end forming bar 86.

Figure 5:
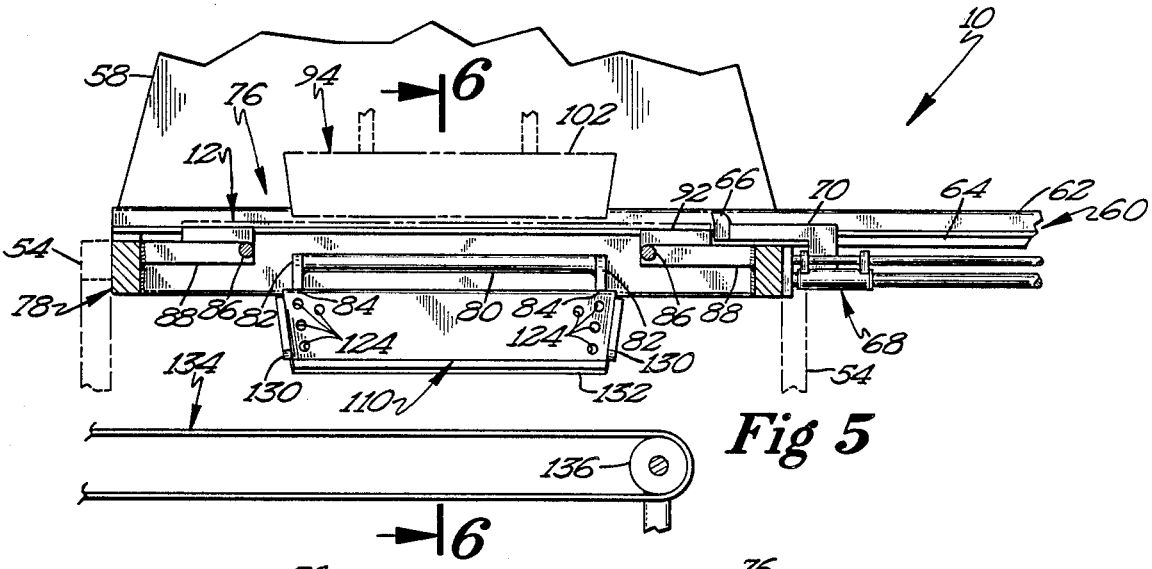
FIG. 5 is a cross sectional view of the tray forming machine of FIG. 1 taken lengthwise through line 5—5 in FIG. 4.

Referring to FIG. 5, it may be seen that each of the end forming bars 86 and end forming brackets 88 are displaced a small distance vertically upward from the top of the side forming bar 80 and are aligned in a vertically coplanar array with one another, and each of the raised top portions 92 of the end foldover forming bars 90 is in turn displaced a small distance vertically upward from the top of the end forming bars 86 and are aligned in a vertically coplanar array with one another.

In situations where blanks 12 which have a high degree of longitudinal warp are to be processed through the tray forming machine 10, it is desirable to include a pair of spaced apart edge guides (not shown) for flattening the warp in the blank 12. These edge guides should have a generally tapered or flared open end facing the rear end 74 of the infeed station 60 to receive the leading end edge of the blank 12 as it is transported toward the blank receiving station 76 from the infeed station 60. The edge guides should extend along the entire length of both sides of the blank receiving station 76 above the forming tool frame 78, and in some cases may extend partially forward a distance into the infeed station 60. As a warped blank 12 is transported toward and into the blank receiving station 76, the leading edge of the blank 12 will be slidably received between the pair of spaced apart edge guides along each opposing side edge thereof. The individual edge guides in each pair are spaced apart a distance approximately equal to or slightly greater than the thickness of the corrugated plastic sheet material 28, such that when the blank 12 is passed longitudinally between the pairs of edge guides, the edge guides will flatten the blank 12 into a generally planar form suitable for forming.

As the blank 12 is transported in a generally linear path from the infeed station 60 to the blank receiving station 76, the blank 12 will generally define a plane having axes parallel with the line along which the infeed hook 66 and push arm 70 are carried, the guide rails 62, and the top surface of the table-like extension 56 of the infeed station 60. In the case of a severely warped blank 12, this plane will extend at least the length of the edge guides.

Positioned vertically above and centered relative to the forming tool frame 78 is a tray forming ram 94. The tray forming ram 94 has a generally rectangular trapezoidal shape conforming to the dimensions and taper of the side walls 16, 18 and end walls 20, 22 of the upright tray 36. The tray forming ram 94 is constructed from a dense, rigid material such as steel and has a generally hollow interior with thick wall segments as shown in FIG. 1.

The tray forming ram 94 is mounted for vertical movment and carried on a plurality of guide posts 96, the guide posts being fastened to the support frame 54 and accurately positioned thereon by locating pins (not shown) in a manner similar to that in which the forming tool frame 78 is fastened to the support frame 54, thus permitting the tray forming ram 94 to be positioned relative to the forming tool frame 78 and forming bars 80, 86 and forming brackets 82, 88, 90 more accurately than might otherwise be accomplished using bushings and similar means.

The tray forming ram 94 is moved in a vertical direction up and down relative to the forming tool frame 78 by a double-acting pneumatic cylinder 98 mounted to the support frame 54. The tray forming ram 94 moves between a raised position at which the bottom surface 100 of the tray forming ram 94 is raised above the plane along which the blank 12 travels a distance greater than the thickness of the corrugated plastic sheet material 28 to permit the blank 12 to pass between the tray forming ram 94 and the top of the forming tool frame 78, and a lowered position whereat the top surface 102 of the tray forming ram 94 is disposed below the inwardly projecting angular lower lip 84 of the side forming brackets 82, thus defining the stroke path of the tray forming ram 84.

Figure 8:
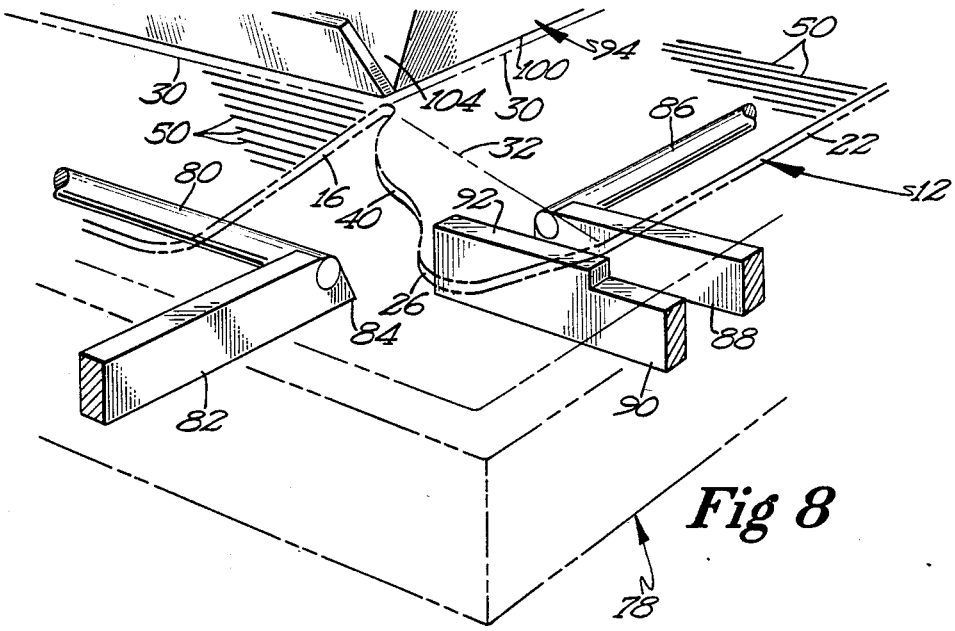
FIG. 8 is a partial perspective view of the corner of the ram and forming tool of FIG. 1 showing the corner of a blank in position for folding.

The bottom surface 100 of the ram 94 has a generally rectangular shape and dimensions substantially equal to the length and width dimensions of the base panel 14 of the blank 12. When a blank 12 has been transferred from the infeed station 60 to the blank receiving station 76, the tray forming ram 94 is positioned vertically above the blank 12 with the edges of the bottom surface 100 of the tray forming ram 94 being aligned with the edges of the base panel 14, and with the edges of the base panel 14 being positioned above and aligned parallel to and generally within the forming tool frame 78 and the side and end forming bars 80, 86. Referring generally to FIGS. 1 and 8, it may be seen that the side and end walls of the tray forming ram 94 are tapered, each side or end having an angle equal to the corresponding angles $\beta$, $\partial$, and $\phi$ of the upright tray 36.

Figure 14:
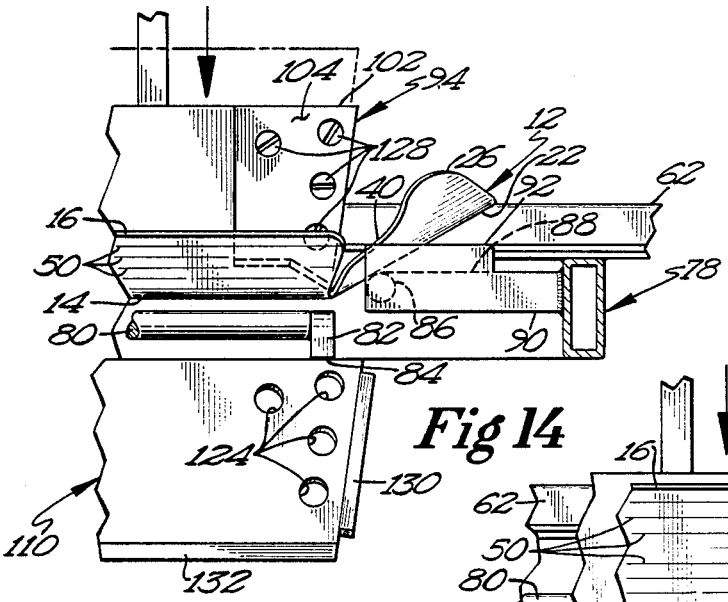
FIG. 14 is a partial side elevation view showing the blank being pressed through the forming tool and folding the end panels upward and end fold-over panels inward.
Figure 15:
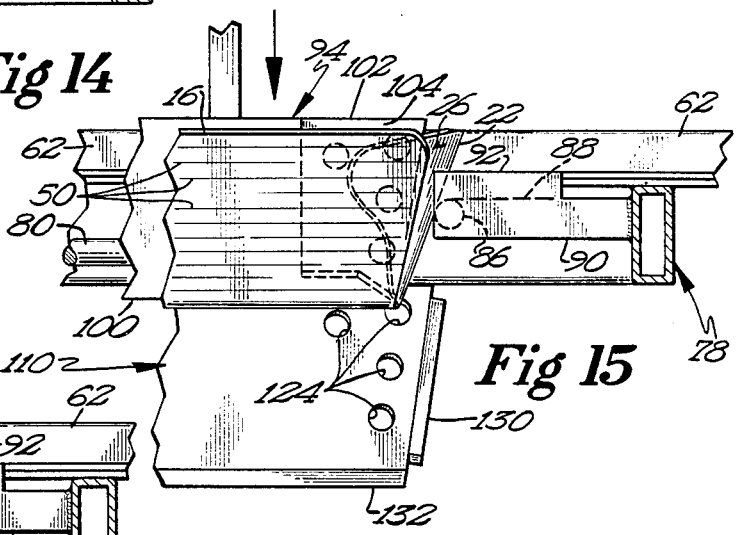
FIG. 15 is a partial side elevation view showing the blank being pressed further through the forming tool.
Figure 16:
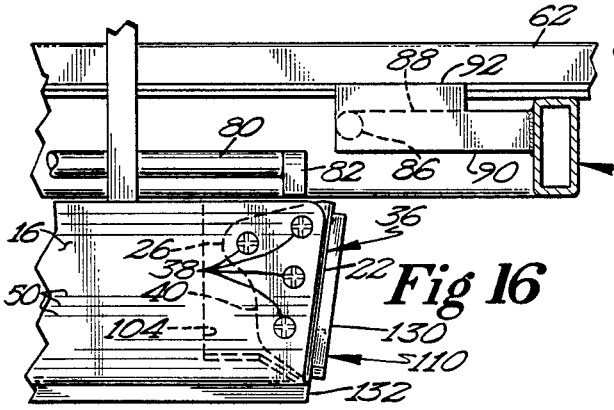
FIG. 16 is a partial side elevation showing the blank received in the area below the forming tool and adjacent the side clamps.

Referring to FIGS. 14–16, it may be seen that as the tray forming ram 94 is moved to the lowered position, the tray forming ram 94 passes through the forming tool frame 78 contacting and carrying the blank 12 therewith. Downward pressure from the tray forming ram 94 on the blank 12 first presses the end foldover panels 24, 24 against the raised top portions 92 of the end foldover forming brackets 90, which causes the end foldover panels 24, 26 to begin folding or pivoting upwardly across the fold lines 32 between the end foldover panels 24, 26 and the corresponding end panels 20, 22 until the end foldover panels are folded to a partially upright configuration. As the tray forming ram 94 and blank 12 proceed downward, the end panels 20, 22 contact and are pressed against the he end forming bars 86 and end forming brackets 88, thereby causing the end panels 20, 22 to begin folding upwardly across the fold lines 30 along which the end panels 20, 22 are connected to the base panel 14, and pivoting the end foldover panels 24, 26 inwardly across the same fold lines 30. As the tray forming ram 94 and blank 12 continue to progress downwardly though the forming tool frame 78, the side panels 16, 18 contact and are pressed against the side forming bars 80 and side forming brackets 82, which in turn fold or pivot the side panels 16, 18 upwardly across the fold lines 30 between the side panels 16, 18 and the base panel 14, thereby bringing the side panels 16, 18, end panels 20, 22, and end foldover panels 24, 26 into their generally upright positions in the tray configuration 36 with the inner planar surface of the side panels 16, 18 closely confronting and contacting the planar outer surfaces of the adjacent end foldover panels 24, 26.

Referring to FIGS. 1 and 8, it may be seen that the each of the sides of the tray forming ram 94 adjacent the corners define a pair of recesses 104 to receive the end foldover panels 24, 26 when the blank 12 is folded to the generally upright configuration 36 and is being carried through the forming tool frame 78 on the tray forming ram 94.

The tray forming ram 94 continues along the downward stroke path through the forming tool frame 78 until the top peripheral edge 106 of the upright tray 36 is disposed a slight distance below the inwardly projecting angular lower lips 84 of the side forming brackets 82. This position may be commensurate with the side panels 16, 18 reaching their most upright position confronting the sides of the tray forming ram 94, thus not requiring any additional stroke length of the tray forming ram 94 subsequent to the blank 12 reaching the upright tray configuration 36.

Beneath the table-like extensions 56 on each side of the forming tool frame 78 and securely fastened to the support frame 54 are a pair of tray clamping and welding assemblies 108. The tray clamping and welding assemblies 108 are positioned on each side of the forming tool frame 78 and generally parallel thereto, and are secured to the support frame in a manner similar to that of the forming tool frame 78. Consequently, when the tray forming ram 94 is lowered through the forming tool frame 78, the tray forming ram 94, forming tool frame 78, and tray clamping and welding assemblies 108 are accurately positioned relative to the support frame 54 and to one another.

Referring particularly to FIG. 1, it may be seen that each of the tray clamping and welding assemblies 108 includes a side clamp 110 carried on and positioned by a pair of guide posts 112 slidably received within retaining blocks 114 and moved inwardly and outwardly relative to the forming tool frame 78 by a double-acting pneumatic cylinder 116, with the guide posts 112, retaining blocks 114, and pneumatic cylinder 116 being mounted to a support shelf 118 which is fixedly attached to the support frame 54 as previously described.

Referring again to FIG. 1, each of the tray clamping and welding assemblies 108 includes a pair of sonic welding devices 120 having a plurality of welding tips 122 positioned in a predetermined array and aligned to extend through a plurality of welding tip apertures 124 positioned in a similar array confined to the areas corresponding to the end foldover panels 24, 26 of the upright tray 36 while the upright tray 36 is carried on the tray forming ram 94. Each sonic welding device 108 is similarly mounted for inward and outward movement relative to the forming tool frame 78 on support frame mounts 126, and are fixedly connected to the support shelf 118 to which the the guide posts 112, retaining blocks 114, and pneumatic cylinders 116 are attached.

Referring to FIG. 8, it may be see that a number of backup pins 128 equal to the number of welding tips 122 are mounted in the recessed portions 104 of the tray forming ram 94 in direct alignment with the welding tips 122. Each of the backup pins 128 is threadedly engaged within a corresponding aperture extending through the wall of the tray forming ram 94 such that the backup pins 128 may be rotated to adjust the extend to which the backup pins 128 protrude from or are recessed into the side surface of the tray forming ram 94. In this manner, the gap between the welding tips 122 and backup pins 128 may be selectively altered in order to adjust the welding gap, and thereby individually control the quality of each of the the sonic welds 38 which secure the end foldover panels 24, 26 to the side panels 16, 18.

Figure 7:
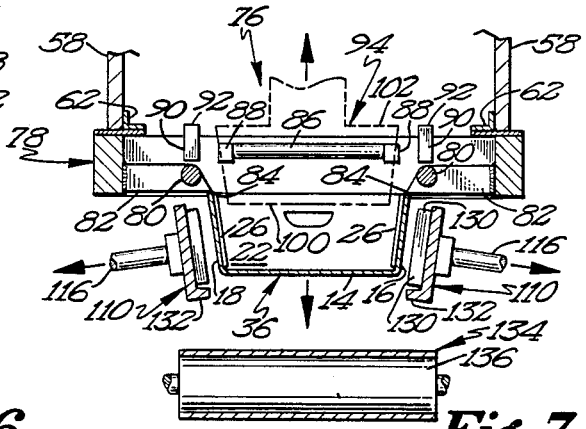
FIG. 7 is a cross sectional view of the tray forming machine of FIG. 1 taken widthwise through line 6—6 in FIG. 5 showing the side clamps and ram retracting.

Referring particularly to FIGS. 6 and 7, it may be seen that the side clamps 110 move inwardly and outwardly relative to the forming tool frame 78 between an extended clamping position as shown in FIG. 6, and a retracted unclamped position as shown in FIG. 7. Because the tray clamping and welding assemblies 108 are mounted at an generally upward angle $\beta$ relative to the generally horizontal forming tool frame 78 such that the side clamps 110 and welding devices 120 move along a path generally perpendicular to the sides of the tray forming ram 94 and the side panels 16, 18 of the blank 12 carried on the tray forming ram 94, the tray clamping and welding assemblies 108 including the side clamps 110 also move in a vertical direction relative to the forming tool frame 78, tray forming ram 94, and the blank 12 carried on the tray forming ram 94.

When in the extended, clamping position, the side clamps 110 may receive the tray forming ram 94 carrying the blank 12 folded to its upright configuration 36 as the tray forming ram 94 passes downwardly through and emerges from the forming tool frame 78, the side clamps 110 clamping and exerting a restraining pressure against the side panels 16, 18 of the blank 12 and pressing those panels 16, 18 inwardly against the sides of the tray forming ram 94. Referring to FIGS. 1 and 5, it may be seen that each of the side clamps 110 includes a pair of end clamp members 130 fastened to each end of the side clamp 110 and extending inwardly therefrom toward the end forming bars 86, and positioned to be aligned with the end panels 20, 22 of the generally upright tray 36 as the blank 12 is carried downwardly on the tray forming ram 94 from the forming tool frame 78. Because the end edges of the side clamp 110 to which the end clamp members 130 are attached are angled corresponding to the angle $\beta$ between the end panels 20, 22 and the base panel 14, the end clamp members 130 will contact and closely confront the planar outer surfaces of the end panels 20, 22 adjacent the corners of the tray 36 when the side clamps 110 are moved inwardly to their clamping position, and similarly clamp and exert a restraining pressure against the end panels 20, 22 of the blank 12 and press those panels 20, 22 inwardly against the ends of the tray forming ram 94.

Referring to FIGS. 1, 6, and 7, it may also be seen that each side clamp 110 includes a lower side ledge 132 extending inwardly from the bottom edge of the side clamp 110 along the length of the side clamp 110, the lower side ledges 132 similarly clamping and exerting a restraining pressure against the base panel 14 of the blank 12 and pressing that panel 14 upwardly against the bottom surface 100 of the tray forming ram 94.

In some applications, it has proven suitable to replace the end clamping members 130 of the side clampls 110 with separate end clamps (not shown) positioned beneath each end of the forming tool frame 78 at the same height as the side clamps 110, each end clamp being carried on and moved by a separate pneumatic cylinder (not shown) between a retracted unclamped position and an extended clamping position in contact with the end panels 20, 22 of the blank 12 being carried on the tray forming ram 94.

The side clamps 110 are extended inwardly to the clamping position when the tray forming ram 94 begins its downward stroke and presses the blank 12 through the forming tool frame 78, and the side clamps 110 therefore receive the blank 12 folded to the form of the tray 36 along with the tray forming ram 94, such that the tray forming ram 94 exerts a pressure on the inner surfaces of the blank 12 equal and opposite to the pressure exerted by the side clamps 110, end clamp members 130, and lower side ledges 132 on the outer surfaces of the blank 12.

While the blank 12 is being held in the clamped position between the side clamps 110, end clamp members 130, lower side ledges 132 and the tray forming ram 94, the welding devices 108 are actuated for a finite period to produce a plurality of sonic welds 38 at the welding tips 122 in the specified array, thereby bonding each of the end foldover panels 24, 26 to the corresponding adjacent and confronting side panels 16, 18 near the end edges thereof to secure the tray 36 in its generally upright configuration.

As the side clamps 110 retract to the unclamped position and the pressure exerted on the folded and secured tray 36 by the side clamps 110, end clamp members 130, and lower side ledge 132 is released, the memory of plastic causes the side panels 16, 18 to spring outwardly a small amount along the peripheral top edge 106 such that the peripheral top edges 106 of the side panels 16, 18 extend under the inwardly projecting angular lower lips 84 of the opposing side forming brackets 82, and catch or hook thereunder.

With the side clamps 110 moving to the retracted unclamped position, and the tray forming ram 94 beginning to move upwardly through the forming tool frame 78, the tray 36 is stripped off the tray forming ram 94 by the downward pressure exerted on the top peripheral edge 106 of the tray 36 by the angular lower lips 84 of the side forming brackets 82. Once clear of the side clamps 110 and tray forming ram 94, the tray 36 is free to fall under the force of gravity in the generally open space beneath the clamping and welding assemblies 108 and onto a pick-off conveyor belt 134 positioned in a conveyor station beneath the forming tool frame 78, the conveyor belt 134 rotating on a series of rollers 136 and driven by a motor (nor shown). The conveyor 134 transports the individual trays 36 to a distinct location where those trays 36 may be stacked, packaged, or used.

In order to coordinate the manual operation of the tray forming machine 10, it is desirable to include various sensing systems and control circuits into the tray forming machine 10. While the tray forming machine 10 may be operated using a conventional dead-man switch 138 as shown in FIG. 1, wherein the operator would place a blank 12 in the infeed station 60 and then depress one of two switch buttons 140 with each hand in order to cause the tray forming machine 10 to cycle, a system responsive to the positions of the tray forming ram 94, blank 12, and operator has proven preferable.

The tray forming machine 10 should preferably include a piece-in-place type sensor (not shown) such as a pair of vertically oriented lights beam and optical sensors positioned near the position of the widthwise edges of the blank 12 when the blank 12 is placed in the infeed station 60, the piece-in-place sensors detecting and indicating whether a blank 12 has been inserted and properly placed within the infeed station 60 such that the infeed hook 66 is adjacent the edge thereof, and producing the appropriate piece-in-place signal when the blank 12 is properly placed. A second monitoring circuit is the operator-interrupt light screen (not shown) which includes a series of horizontally oriented light beams and optical sensors which are positioned to define a generally planar light screen or plane approximately 4" above the path of the blank 12 in the infeed station 60 and extending completely along the length of the infeed station 60 and across the width between the guide rails 62. By the use of such a light screen electrically connected to the control circuitry of the tray forming machine 10, the cycling of the tray forming machine 10 may be interrupted and the tray forming machine 10 instantaneously stopped in response to the operator placing his hand or any object through the light screen above the infeed station 60. An additional sensor such as a limit switch (not shown) may be positioned on the support frame 54 or housing 58 above the tray forming ram 94 to signal when the tray forming ram 94 reaches the top of the upstroke, and similarly limit switches may be placed beneath the forming tool frame 78 and attached to the support frame 54 to signal when the tray forming ram 94 is at the bottom of the downstroke and when the side clamps 110 are in the extended and clamped or retracted and unclamped positions. Finally, a pair of optical piece size and placement sensors may be placed within the housing 58 along the forming tool frame 78 to indicate whether the blank 12 received in the blank receiving station 76 is of the proper length and positioned to be accommodated by the tray forming machine 10.

With these sensors connected to the main logic and control circuitry of the tray forming machine 10, the tray forming machine 10 may be automatically cycled while blanks 12 are manually placed one at a time in the infeed station 60.

In operation, an operator selects a flat blank 12 from a supply of similar blanks 12, and inserts that blank 12 into the infeed station 60 of the tray forming machine 10 between and above the L-shaped guide rails 62 with one widthwise edge of the blank proximate to and confronting the infeed hook 66. When the control circuit receives simultaneous signals that the tray forming ram 94 is in position at the top of its stroke path, that the piece-in-place sensors indicate a blank 12 is in place within the infeed station 60, and the light curtain is uninterrupted, the control circuit will signal to fire or begin the cycle of the tray forming machine 10. Responsive to this command or signal from the control circuit, the rodless cylinder 68 will propel the push arm 70 and infeed hook 66 toward the rear end 74 of the infeed station 60, thereby delivering the blank 12 into position within the blank receiving station 76, the blank 12 passing through and between the spaced apart edge guides to flatten any warp in the blank 12. If during this transport process the light screen is broken, the cycling of the tray forming machine 10 will be interrupted.

Once the blank 12 is received within the blank receiving station 76, the piece-size and placement sensors will indicate whether the blank 12 is the proper size and in the proper position for the tray forming machine 10 to continue cycling. If the blank 12 is in the proper position and is of the proper size, the control circuit will activate the double-acting pneumatic cylinder 98 to start the tray forming ram 94 on its downward stroke through the forming tool frame 78 and toward the side clamps 110 which are in the extended, clamped position. The bottom surface 100 of the tray forming ram 94 will contact the base panel 14 of the blank 12, and the blank 12 will be sequentially folded to the generally upright tray configuration 36 by the raised portion 92 of the end foldover forming brackets 90, the end forming bars and brackets 86, 88, and side forming bars and brackets 80, 82, as the tray forming ram 94 carries the blank 12 through the forming tool frame 78.

The tray forming ram 94 presses the folded blank 12 into contact with the side clamps 110, end clamp members 130, and lower side ledge 132, with the end foldover panels 24, 26 being received within the recessed portions 104 along the sides of the tray forming ram 94, and the sonic welding devices 120 are activated and produce welds 38 which bond the end foldover panels 24, 26 to the adjacent side panels 16, 18 thus forming the generally upright tray 36.

Once the control circuit registers that proper welds 38 have been formed, the control circuit then produces a signal to actuate the double-acting pneumatic cylinder 98 to begin raising the tray forming ram 94 along its upstroke, and the side clamps 110 are simultaneously released and retracted. Because the side clamps 110 move rapidly relative to the stroke of the tray forming ram 94, the top peripheral edge 106 of the tray 36 is immediately caught under the angular lower lips 84 of the side forming brackets 82 and stripped from the tray forming ram 94. The tray 36 is then free to drop onto the conveyor belt 136 and be carried to a location for other activities.

At some time during the cycling of the tray forming machine 10 subsequent to the delivery of the blank 12 to the blank receiving station 76, the rodless cylinder 68 returns the push arm 70 and infeed hook 66 to the initial position at the front end 72 of the infeed station 60. Because the rate of cycling of the tray forming machine 10 may be relatively fast, it is preferable that the push arm 70 and infeed hook 66 return to this initial position as early in the cycle as possible, preferably when the tray forming ram 94 begins its downstroke.

Figure 11:
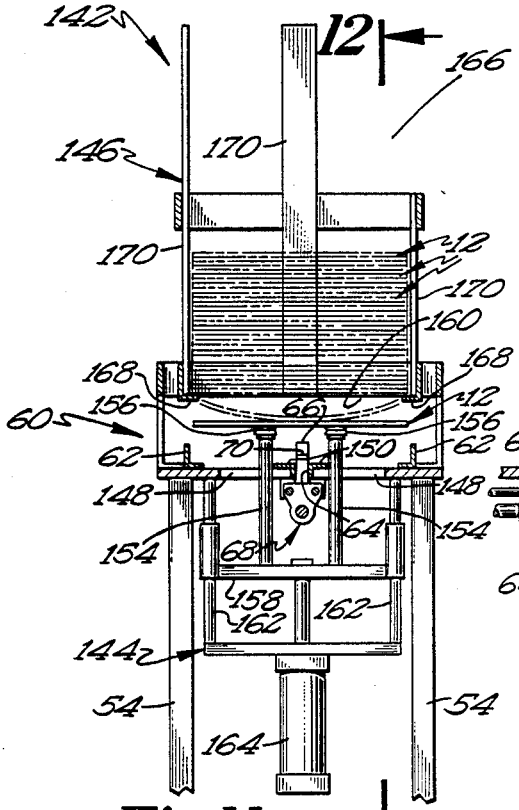
FIG. 11 is a cross sectional end view of the tray forming machine of this invention showing the blank magazine and retractable gripping means.

In order to automate the operation of the tray forming machine 10, it is possible to replace the manual feeding of the blanks 12 into the infeed station 60 with a bag magazine 142 and a retractable gripping assembly 144. Referring to FIG. 11, it may be seen that in such an embodiment the bag magazine 142 is suspended or mounted on an independent frame assembly 146 above the table-like extension 56 of the infeed station 60. The table-like extension 56 may define a pair of openings 148 extending completely therethrough, or the entire support surface for the blank 12 may be comprised of a pair of spaced apart, inverted L-shaped angle irons 150 and the guide rails 62, with the track 64 for the push arm 70 and infeed hook 66 being defined between the pair of spaced apart, inverted angle irons 150. These openings 148 should be spaced apart sufficiently on each side of the track 64 to permit a pair of gripping arms 152 each having a vacuum actuated gripping member 156 or suction cup attached at the distal end thereof and connected by a cross brace 158, to extend through the plane of the infeed station 60 and upwardly to the open bottom 160 of the magazine. The cross brace 158 may be slidably mounted for vertical movement on a pair of guide posts 162 which extend into a portion of the support frame 54, with the cross brace 158 and gripping arms 154 being moved up and down in a vertical direction by a double-acting pneumatic cylinder 164.

Figure 12:
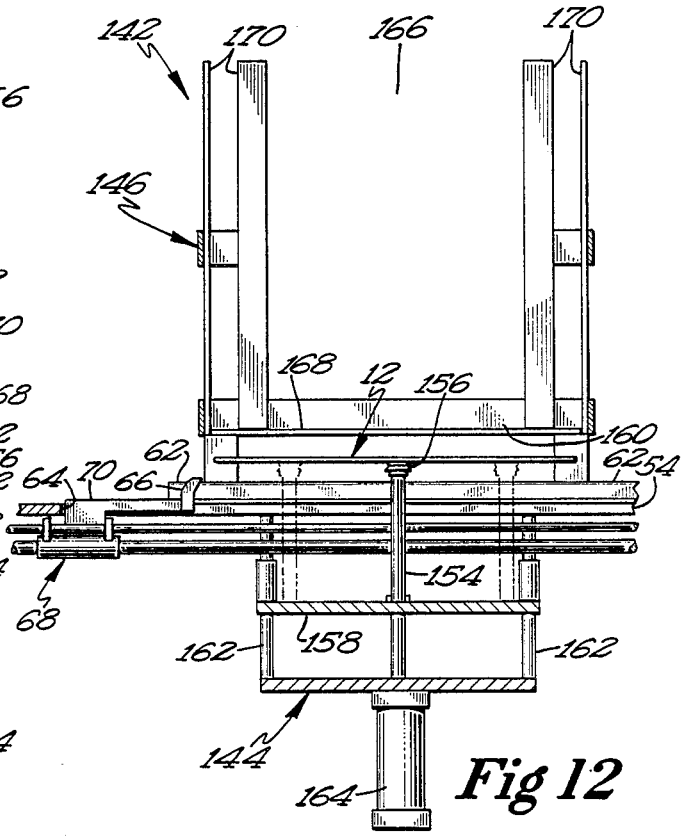
FIG. 12 is a side elevation view of the bag magazine with a gripping member gripping the bottom blank.

Referring to FIG. 12, it may be seen that the blanks 12 are fed into the magazine through an open top 166 and are removed from the open bottom 160. In this manner, the supply of blanks 12 in the magazine 142 may be constantly replenished while the tray forming machine 10 is in operation. The stack of blanks 12 within the magazine is supported along the lengthwise or widthwise edges of the bottom blank 12 by a pair of ridges 168 which project inwardly from the sides 170 of the magazine 142 and extend under the edges of the bottom blank 12.

In operation, the control circuit actuates the double-acting pneumatic cylinder 164 which raised the retractable gripping assembly 144 such that the gripping arms 154 pass through the plane of the infeed station 60 and the table-like extension 54, or alternately between the guide rails 62 and angle irons 150, until the gripping members 156 contact the bottom blank 12 in the magazine 142. With the gripping members 156 actuated to produce a gripping force such as a vacuum against the planar surface of the blank 12, the pneumatic cylinder 164 is again actuated to retract downward, thus exerting a downward pulling force on the blank 12 through the gripping arms 154 and cross brace 158. This causes the bottom blank 12 to bow or bend downwardly in the center as shown in FIG. 12, thus shortening the crosswise length of the blank 12 relative to the opposing and spaced apart ridges 168, with the downward pulling force continuing until the bottom blank 12 pulls free of the ridges 168 and is removed completely from the magazine 142. The blank 12 is lowered by the retractable gripping assembly 144 until the edges of the blank 12 rest on the guide rails 62 and the center of the blank 12 rests on top of the angle irons 150. The gripping members 156 may then be deactivated to release their gripping force on the blank 12, and the tray forming machine 10 may then continue to cycle as previously described.

While it is possible when manually feeding the blanks 12 into the infeed station 60 to orient those blanks 12 with the end edge of the blank 12 proximate to the rear end 74 angled downwardly relative to the plane of the infeed station 60, or to manually feed or load those blanks 12 such that the end edge proximate to the rear end 74 of the infeed station 60 actually extends partially into the blank receiving station 76 above the forming tool frame, such an orientation is not as readily achieved when using an automated magazine 142 and retractable gripping assembly 144. Consequently, when using an automated magazine 142 and retractable gripping assembly 144 as described above, it may be preferable to extend the length of the infeed station 60 between the front and rear ends 72, 74 thereof, and similarly to extend the stroke length of the rodless cylinder 68 and the length of the path of the infeed hook 66 and push arm 70.

While the preferred embodiment of the above tray forming machine 10 has been described in detail above with reference to the attached figures, it is understood that various changes and adaptations may be made in the tray forming machine without departing from the spirit and scope of the appended claims.

What is claimed is:

1. A tray forming machine for folding a blank of corrugated plastic into a generally upright configuration to form a tray and for securing said tray in said upright configuration, said blank being cut from a sheet of corrugated plastic to define a bottom wall panel and a pair of opposing side wall panels and a pair of opposing end wall panels, said side wall panels and said end wall panels being hingedly connected to said bottom panel along scored fold lines, said tray forming machine comprising:

a frame structure;

an infeed station defined by said frame structure for receiving the blank of corrugated plastic and having a transfer mechanism for conveying the blank of corrugated plastic along a generally linear transfer path, the blank of corrugated plastic defining a plane as the blank moves along said transfer path;

a blank receiving station defined by said frame structure for receiving the blank from said infeed station as the blank is conveyed along said transfer path by said transfer mechanism;

a tray forming ram, said tray forming ram being mounted on said frame structure above said blank receiving station for movement along a generally linear stroke path between a raised position and a lowered position, said stroke path being generally perpendicular to and extending through said plane defined by the blank of corrugated plastic moving along said transfer path;

a forming tool frame, said forming tool frame being mounted on said frame structure, said forming tool frame being positioned beneath said blank receiving station and being generally vertically aligned with said tray forming ram, said forming tool frame defining an opening such that said tray forming ram passes through said opening as said tray forming ram traverses said stroke path;

a plurality of tray forming members, each said tray forming member being connected to said frame structure and extending inwardly relative to said opening of said forming tool frame to obstruct at least a portion of said opening;

clamping means movably mounted on said frame structure and positioned beneath said forming tool frame on opposing sides thereof, said clamping means being mounted to move in a generally horizontal direction between a retracted position displaced from said tray forming ram when in said lowered position and an extended position displaced from said retracted position and disposed proximate to said tray forming ram when in said lowered position; and fastening means for securing each of the end wall panels to at least one of the side wall panels in the generally upright configuration, said fastening means being mounted in a position such that said fastening means is adjacent to the tray forming ram when the tray forming ram is in the lowered position and when the fastening means if securing one of the end wall panels to one of the side wall panels, whereby the blank is selectively placed in the infeed station and conveyed by the transfer mechanism to the blank receiving station, at which time the tray forming ram moves downward along the stroke path through the opening of the forming tool frame to the lowered position, the tray forming ram thereby contacting and carrying the blank downward through the opening in the forming tool frame and against the plurality of tray forming members, such that the tray forming members fold the end wall panels and the side wall panels of the blank into the generally upright configuration, the clamping means being in the extended position and the blank being disposed between and contacting both the tray forming ram and the clamping means, the clamping means exerting pressure against the blank in order to clamp the blank against the ram and maintain the blank in the upright configuration as the fastening means secures the end wall panels and side wall panels in the generally upright configuration, the clamping means then moving to the retracted position and the tray forming ram returning to the raised position such that the tray falls downwardly from the tray forming ram.

2. The tray forming machine of claim 1 wherein the opening of the forming tool frame is generally rectangular and the plurality of tray forming members includes a pair of side forming bars and a pair of end forming bars, said side folding bars being connected to the forming tool frame and disposed such that at least a portion of each of the side wall panels contacts one of said side forming bars as the blank is carried downward through the opening in the forming tool frame, said end folding bars being connected to the forming tool frame and disposed such that at least a portion of each of the end wall panels contacts one of said end forming bars as the blank is carried downward through the opening in the forming tool frame, whereby the side forming bars fold the side wall panels into the upright configuration, and the end forming bars fold the end wall panels into the upright configuration.

3. The tray forming machine of claim 2 wherein the side forming bars and the end forming bars are positioned such that at least a portion of each of the end forming bars contacts the end wall panels before the side forming bars contact the side wall panels.

4. The tray forming machine of claim 2 wherein each of the end forming bars has a top and each of the side forming bars has a top, said top of the end forming bars being displaced a distance vertically upward relative to said top of the side forming bars, such that said top of the end forming bars is closer to the raised position of the tray forming ram than said top of the side forming bars.

5. The tray forming machine of claim 2 wherein each of the side forming bars has a pair of opposing ends and each of the end forming bars has a pair of opposing ends, each of the side forming bars being mounted between a pair of side forming brackets, one of said side forming brackets being connected to each of the opposing ends of the side forming bar, said side forming brackets being connected to and extending inwardly from the forming tool frame into and partially obstructing the opening, each of the end forming bars being mounted between a pair of side forming brackets, one of said end forming brackets being connected to each of the opposing ends of the end forming bar, said end forming brackets being connected to and extending inwardly from the forming tool frame and partially obstructing the opening.

6. The tray forming machine of claim 5 wherein the tray has a peripheral top edge when folded to the upright configuration, and wherein each of the side forming brackets has an inwardly projecting lower lip, each said lower lip extending inwardly into the opening sufficiently such that a portion of the peripheral top edge of the tray is engagingly received under said lower lip, whereby each said lower lip exerts pressure downwardly on said peripheral top edge of said tray as the tray forming ram moves to the raised position to strip the tray off the tray forming ram.

7. The tray forming machine of claim 1 further comprising:

means for stripping the tray from the tray forming ram as the tray forming ram moves upward to the raised position.

8. The tray forming machine of claim 7 wherein the tray has a peripheral top edge when folded to the upright configuration, and wherein the means for stripping the tray from the tray forming ram comprises:

a plurality of brackets, said brackets extending from and connected to said forming tool frame, each said bracket including an inwardly projecting lower lip, each said lower lip extending inwardly into the opening sufficiently such that a portion of the peripheral top edge of the tray is engagingly received under said lower lip, whereby each said lower lip exerts pressure downwardly on said peripheral top edge of said tray as the tray forming ram moves to the raised position to strip the tray off the tray forming ram.

9. The tray forming machine of claim 1 wherein the end wall panels each have a pair of opposing side edges, and the blank further includes two pair of end foldover panels, each said end foldover panel extending from and being hingedly connected to one of said side edges of one of said end foldover panels along scored fold lines, said tray forming machine further comprising:

a plurality of end foldover forming bars, each of said end foldover forming bars extending inwardly from a being connected to the forming tool frame and partially obstructing the opening, the end foldover forming bar contact at least a portion of the end foldover panels as the blank is carried through the opening by the tray forming ram such that the end foldover forming bars fold each of the end foldover panels into the generally upright configuration.

10. The tray forming machine of claim 9 wherein the end foldover forming bars and the end forming bars are positioned such that the end foldover panels begin to be folded to the upright configuration by the end foldover forming bars prior to the end panels beginning to be folded to the upright configuration by the end forming bars, and the end panels begin to be folded to the upright configuration by the end forming bars prior to the side panels beginning to be folded to the upright configuration by the side forming bars.

11. The tray forming machine of claim 9 wherein the forming tool frame has a pair of opposing lengthwise sides and a pair of opposing widthwise sides, and wherein the side forming bars are connected to and extend inwardly from said lengthwise sides of the forming tool frame, and the end forming bars and end foldover forming bars are connected to and extend inwardly from said widthwise sides of the forming tool frame.

12. The tray forming machine of claim 9 wherein the forming tool frame has a pair of opposing lengthwise sides and a pair of opposing widthwise sides, and wherein the side forming bars are connected to and extend generally parallel to said lengthwise sides of the forming tool frame, the end forming bars are connected to and extend generally parallel to said widthwise sides of the forming tool frame.

13. The tray forming machine of claim 9 wherein the tray forming ram has a pair of opposing sides, each said opposing side being positioned proximate to and in close confronting contact with one of the side wall panels of the blank as the blank is carried toward the lowered positioned on the tray forming ram, each said side of the tray forming ram defining a pair of recesses, said recesses each receiving one of the end foldover panels when the blank is folded to the upright configuration and carried on the tray forming ram.

14. The tray forming tool of claim 1 wherein the blank has a rear edge, and wherein a second like blank having a rear edge is positioned in the infeed station subsequent to the blank being conveyed to the blank receiving station by the transfer mechanism, and the transfer mechanism for conveying the blank from the infeed station to the blank receiving station comprises:

an infeed hook, said infeed hook mounted for reciprocal movement along a linear track, said track extending from the rear of blank when the blank is positioned in the infeed station to a position generally proximate to the blank receiving station, said infeed hook extending upwardly such that a portion of the infeed hook contacts and pushingly engages the rear edge of the blank when the blank is in the infeed station; and a rodless cylinder, said rodless cylinder being mounted to the frame and connected to said infeed hook, said rodless cylinder responsively moving said infeed hook along said track to push the blank from the infeed station subsequently returning said infeed hook along said track such that said infeed hook engages the rear edge of the second blank.

15. The tray forming machine of claim 1 further comprising:

conveyor belt means for carrying the tray after the tray has been folded and secured in the upright configuration, said conveyor belt means being disposed beneath the opening of the forming tool frame and the lowered position of the tray forming ram such that when the tray falls downwardly from the tray forming ram the tray drops onto the conveyor belt means and is carried therewith.

16. The tray forming machine of claim 1 wherein the forming tool frame has a pair of opposing sides and the tray forming ram has a pair of opposing lengthwise sides, and wherein the clamping means comprises:

a pair of side clamps, each said side clamp being positioned adjacent to one of the opposing sides of the forming tool frame and on opposing sides of the tray forming ram when the tray forming ram is in the lowered position, each said side clamp being movably mounted to move inwardly and outwardly in a generally horizontal direction relative to the forming tool frame such that the side clamps each contact and press one of the side panels of the blank into clamping contact with the lengthwise sides of the tray forming ram.

17. The tray forming machine of claim 16 wherein the end wall panels each have pair of opposing side edges, and the blank further includes two pair of end foldover panels, each said end foldover panel extending from and being hingedly connected to one of said side edges of one of said end foldover panels along scored fold lines and being folded across said scored fold lines in close confronting contact with one of said side wall panels, and wherein the fastening means comprises:

a plurality of sonic welding devices, each said sonic welding device having at least one welding tip, said sonic welding devices being moveable between an extended position proximate to and closely confronting the tray forming ram when the tray forming ram is in the lowered position and a retracted position displaced from the tray forming ram, said sonic welding devices being capable of sonicly welding the end foldover wall panels to the adjacent and closely confronting side panel with at least one sonic weld when the sonic welding devices are in the extended position.

18. The tray forming machine of claim 17 wherein each of the side clamps defines at least one aperture, said aperture being positioned such that at least a portion of the welding tip of one of the sonic welding devices may be received through the aperture when the sonic welding devices are moved to the extended position proximate to the tray forming ram.

19. The tray forming machine of claim 16 wherein the end wall panels each have an outer planar surface when the blank is folded to the upright configuration, and each of the side clamps has a pair of opposing ends, the side clamps further comprising:

a pair of end clamp members, each end clamp member being connected to and extending inwardly from one of the ends of the side clamp, said end clamp members each contacting and closely confronting the planar outer surface of one of the end wall panels, said end clamp members exerting a clamping pressure on the end wall panels to retain the end wall panels in the upright configuration.

20. The tray forming machine of claim 16 wherein each of the side clamps has a bottom edge, the side clamps further comprising:

a lower side ledge, each lower side ledge being connected to and extending inwardly from the bottom edge of the side clamp, said lower side ledge contacting and closely confronting the base panel of the blank, said lower side ledge exerting pressure upwardly on the base panel to retain the base panel in contact with the tray forming ram.

21. The tray forming machine of claim 16 wherein the side wall panels of the tray and the end panels of the tray angle outwardly at an angle relative to vertical when secured in the upright configuration, and wherein the forming ram has a pair of opposing lengthwise sides and a pair of opposing widthwsise sides, each of said opposing lengthwise sides and said widthwise sides being angled relative to vertical approximately equal to the angle of the side wall panels and the end panels, and wherein the side clamps are angled relative to vertical approximately equal to the angle of the side wall panels.

22. The tray forming machine of claim 21 wherein the side clamps move between the retracted position and the extended position in a vertical direction at an angle relative to horizontal equal to the angle that the side clamps are angled relative to vertical.

23. A tray forming machine for folding a blank of corrugated plastic into a generally upright configuration to form a tray and for securing said tray in said upright configuration, said blank being cut from a sheet of corrugated plastic to define a bottom wall panel and a pair of opposing side wall panels and a pair of opposing end wall panels, said side wall panels and said end wall panels being hingedly connected to said bottom panel along scored fold lines, said he end wall panels each having a pair of opposing side edges, said blank further including two pair of end foldover panels, each said end foldover panel extending from and being hingedly connected to one of said side edges of one of said end foldover panels along scored fold lines and being folded across said scored fold lines in close confronting contact with one of said side wall panels, said tray forming machine comprising:

a frame structure;

an infeed station defined by said frame structure for receiving the blank of corrugated plastic and having a transfer mechanism for conveying the blank of corrugated plastic along a generally linear transfer path, the blank of corrugated plastic defining a plane as the blank moves along said transfer path;

a blank receiving station defined by said frame structure for receiving the blank from said infeed station as the blank is conveyed along said transfer path by said transfer mechanism;

a tray forming ram, said tray forming ram being mounted on said frame structure above said blank receiving station for movement along a generally linear stroke path between a raised position and a lowered position, said stroke path being generally perpendicular to and extending through said plane defined by the blank of corrugated plastic moving along said transfer path;

a forming tool frame, said forming tool frame being mounted on said frame structure, said forming tool frame being positioned beneath said blank receiving station and being generally vertically aligned with said tray forming ram, said forming tool frame defining an opening such that said tray forming ram passes through said opening as said tray forming ram traverses said stroke path;

a plurality of tray forming members, each said tray forming member being connected to said frame structure and extending inwardly relative to said opening of said forming tool frame to obstruct at least a portion of said opening;

clamping means movably mounted on said frame structure and positioned beneath said forming tool frame on opposing sides thereof, said clamping means being mounted to move in a generally horizontal direction between a retracted position displaced from said tray forming ram when in said lowered position and an extended position displaced from said retracted position and disposed proximate to said tray forming ram when in said lowered position;

fastening means for securing each of the end wall panels to at least one of the side wall panels in the generally upright configuration, said fastening means including a plurality of sonic welding devices, each said sonic welding device having at least one welding tip, said sonic welding devices being capable of sonicly welding the end wall panels to the adjacent and closely confronting side wall panel with at least one sonic weld, said sonic welding devices being connected to and carried with the clamping means and moveable between an extended position proximate to and closely confronting the tray forming ram when the tray forming ram is in the lowered position and a retracted position displaced from the tray forming ram.

24. The tray forming machine of claim 27 wherein the tray forming ram has a plurality of corners, each said corner having at least one backup pin attached thereto and aligned with one of the welding tips of one of the sonic welding devices when the tray forming ram is in the lowered position and the sonic welding devices are in the extended position.

25. The tray forming machine of claim 18 wherein the backup pins are movably mounted on the tray forming ram such that the distance between each of the backup pins and the tip of each of the confronting sonic welding devices when the sonic welding devices are in the extended position may be selectively altered.

* * * * *